US006237810B1

(12) United States Patent
Credle, Jr.

(10) Patent No.: US 6,237,810 B1
(45) Date of Patent: May 29, 2001

(54) MODULAR BEVERAGE DISPENSER

(75) Inventor: William S. Credle, Jr., Stone Mountain, GA (US)

(73) Assignee: The Coca-Cola Company, Atlanta, GA (US)

( * ) Notice: Subject to any disclaimer, the term of this patent is extended or adjusted under 35 U.S.C. 154(b) by 0 days.

(21) Appl. No.: 09/537,607

(22) Filed: Mar. 29, 2000

(51) Int. Cl.[7] ..... B67D 1/16
(52) U.S. Cl. ..... 222/108; 222/129.1; 222/146.6
(58) Field of Search ..... 222/129.1, 129.2, 222/129.3, 129.4, 146.6, 108

(56) References Cited

U.S. PATENT DOCUMENTS

| | | | | |
|---|---|---|---|---|
| 4,272,968 | | 6/1981 | Harvill | 62/394 |
| 4,319,441 | | 3/1982 | Credle | 53/131 |
| 4,592,490 | * | 6/1986 | McMichael | 222/129.1 |
| 4,615,466 | * | 10/1986 | Credle, Jr. | 222/129.1 |
| 4,781,310 | * | 11/1988 | Credle, Jr. et al. | 222/129.1 |
| 4,801,048 | | 1/1989 | Credle, Jr. et al. | 222/129.1 |
| 4,903,862 | | 2/1990 | Shannon et al. | 222/54 |
| 4,951,719 | | 8/1990 | Wiley et al. | 141/1 |
| 4,979,639 | | 12/1990 | Hoover et al. | 222/1 |
| 5,033,651 | | 7/1991 | Whigham et al. | 222/145 |
| 5,058,782 | | 10/1991 | Shannon | 222/330 |
| 5,074,341 | | 12/1991 | Credle, Jr. et al. | 141/1 |
| 5,190,188 | | 3/1993 | Credle, Jr. | 222/1 |
| 5,190,189 | * | 3/1993 | Zimmer et al. | 222/67 |
| 5,192,000 | | 3/1993 | Wandrick et al. | 222/59 |
| 5,314,091 | | 5/1994 | Credle, Jr. | 222/129.1 |
| 5,890,626 | * | 4/1999 | Wolski et al. | 222/129.1 |
| 5,992,685 | | 11/1999 | Credle, Jr. | 222/1 |
| 6,053,359 | | 4/2000 | Goulet et al. | 221/221 |

* cited by examiner

*Primary Examiner*—Kenneth Bomberg
(74) *Attorney, Agent, or Firm*—Sutherland Asbill & Brennan, LLP

(57) ABSTRACT

A modular mounting block for a beverage dispenser. The modular mounting block includes a number of pump compartments and a number of dispensing valve compartments formed integrally within the block.

18 Claims, 7 Drawing Sheets

MODULAR BEVERAGE DISPENSER

TECHNICAL FIELD

The present invention relates to a beverage dispenser, and more particularly relates to a beverage dispenser with modular components for simplified and efficient assembly, repair, and replacement.

BACKGROUND OF THE INVENTION

Beverage dispensers, such as those used for carbonated soft drinks and like, are well known in the art. Examples of known beverage dispensers include commonly-owned U.S. Pat. No. 4,781,310 and U.S. Pat. No. 4,801,048, both entitled "Beverage Dispenser", and commonly-owned U.S. Pat. No. 5,190,188, entitled "Convertible Beverage Dispenser". These patents are incorporated herein by reference.

As is shown in these references, most beverage dispensers include a water bath with a refrigeration deck positioned thereon. The refrigeration deck supports the refrigeration equipment, such as a compressor. The compressor generally is connected to a series of evaporation coils positioned within the water bath. The evaporation coils remove heat from the water of the water bath as is known to those skilled in the art so as to provide cooling.

A beverage dispenser also generally includes a series of syrup circuits and water circuits. The syrup circuits generally include an incoming syrup line, a syrup pump, and a series of syrup cooling coils positioned within the water bath. Alteratively, a cold plate system also could be used. The source of the syrup may be a bag-in-box, a figal, a syrup tank, or any other type of conventional syrup source. The water circuits generally include an incoming water line, a water pump, a carbonator, and a series of water cooling coils positioned within the water bath or the cold plate. The source of the water is generally tap water or any other type of conventional water source. The carbonator adds carbon dioxide bubbles to the incoming water stream so as to produce soda water. The syrup circuits and the water circuits are then joined at a dispensing valve for mixing. The syrup and the water are cooled in the respective cooling coils or the cold plate so as to provide the beverage at the appropriate temperature. The beverage is then dispensed through the dispensing valve nozzle.

To construct a beverage dispenser, one generally starts with the water bath. One or more plates are bolted onto the water bath. Mounting blocks for the dispensing valves are then bolted onto the plates. The dispensing valves themselves are then attached by bolts, screws, or other conventional types of fastening means. Several additional brackets are also attached. The water pump and the syrup pumps are then attached to these brackets by bolts, screws, or other conventional types of fastening means. Each of the dispensing valves and the pumps also has various fittings. The dispensing valves and the pumps are then connected by multiple fluid lines. Finally, the electronics and other controls may be installed.

In sum, the construction of a beverage dispenser is a time consuming process because it requires the coordination and cooperation of multiple elements. The installation of each element of the dispenser requires multiple screws, fittings, and fluid lines. Further, because of the large number of elements, repairing or replacing one component is often difficult. Repair or replacement of one component often requires the entire beverage dispenser to be taken out of service.

What is needed, therefore, is a simplified means for constructing a beverage dispenser. Such a beverage dispenser should have significantly fewer parts so as to provide for a simplified and efficient construction. Such a beverage dispenser also should permit simplified and efficient replacement of parts. Further, the beverage dispenser itself should be reasonably priced.

SUMMARY OF THE INVENTION

The present invention provides a modular mounting block for a beverage dispenser. The modular mounting block includes a number of pump compartments and a number of dispensing valve compartments formed integrally within the mounting block.

Specific embodiments of the present invention may include the modular mounting block being made out of a thermoplastic material. The pump compartments may include a number of syrup pump compartments and at least one water pump compartment. The dispensing valve compartments each may include a recess positioned therein and supports for a syrup conduit and a water conduit. The modular mounting block also may include a number of footings and an overflow conduit.

A further embodiment of the present invention provides for a modular beverage dispenser. The modular beverage dispenser includes a water bath with a mounting block fixedly attached thereto. The mounting block includes a number of pump compartments and a number of dispensing valve compartments. A water pump is positioned within a first one of the pump compartments, a syrup pump is positioned within a second one of the pump compartments, and a dispensing valve is positioned within one of the dispensing valve compartments. The first pump compartment may be a water pump compartment and the second pump compartment may be a syrup pump compartment. Any number of water pump compartments and syrup pump compartments may be used. The mounting block and the water bath may be made from a thermoplastic material. The water bath may include a drip path molded therein while the mounting block may include an overflow conduit in alignment with the drip path of the water bath.

The water pump is placed into the first pump compartment and then retained by a snap fit, a screw, a bolt, or other conventional types of fastening means. The syrup pump is placed into the second pump compartment and then may be retained by a snap fit, a screw, a bolt, or other conventional types of fastening means. Further, the dispensing valve is placed into the one of the dispensing valve compartments and then may be retained by a snap fit, a screw, a bolt, or other conventional types of fastening means.

A further embodiment of the present invention provides for a number of fluid lines to be connected to the water pump, the syrup pump, and the dispensing valve. One or more of these fluid lines may include a quick disconnect fitting. The quick disconnect fitting includes a retractable plunger positioned within a housing. The retractable plunger also includes an arm so as to position the retractable plunger within the housing. In use, the dispensing valve snaps into one of the quick disconnect fittings for connection to one of the fluid lines.

The method of the present invention provides for the construction of a beverage dispenser. The method includes the steps of securing a mounting block onto a water bath, with the mounting block including a number of pump compartments and dispensing valve compartments. The method further includes the steps of placing a water pump within one of the pump compartments, placing a syrup pump within another one of the pump compartments, and placing a dispensing valve within one of the dispensing valve compartments. The method may further include the step of attaching the fluid lines to the water pump, the syrup pump, and the dispensing valve. The fluid lines may include a quick disconnect fitting such that the dispensing valve snaps into the quick disconnect fitting. The beverage dispenser may have a number of the dispensing valves operating therein. The method of the present invention also provides for the removal of one of the dispensing valve while continuing to operate the remaining valves of the beverage dispenser.

Other objects, features, and advantages of the present invention will become apparent upon review of the following detailed description of the preferred embodiments of the invention, when taken in conjunction with the drawings and the appended claims.

DETAILED DESCRIPTION OF THE INVENTION

Figure 1:
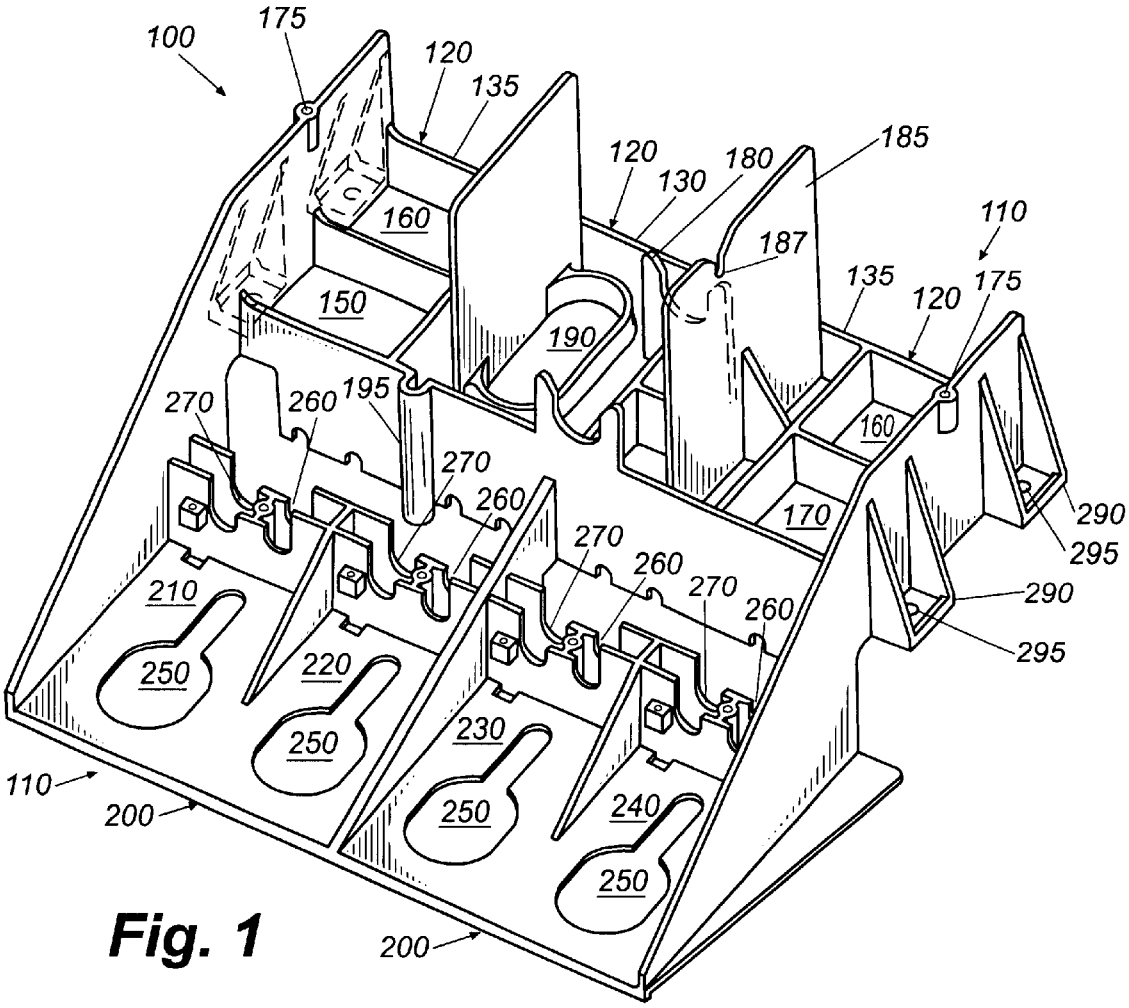
FIG. 1 is a perspective view of a modular mounting block of the present invention.
Figure 2:
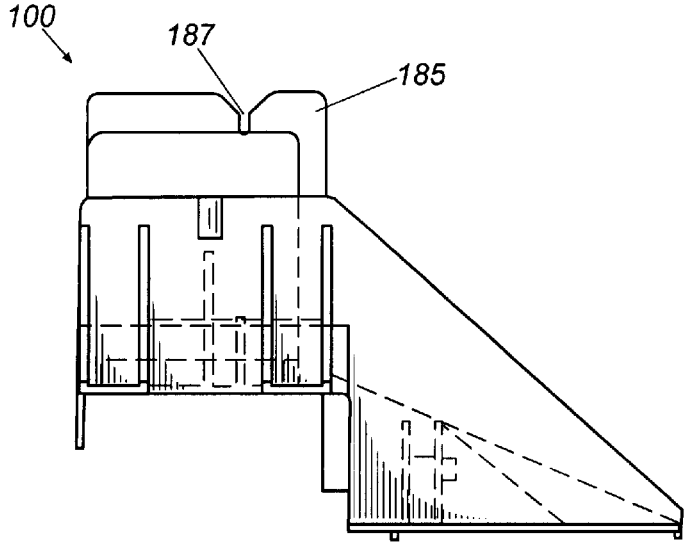
FIG. 2 is a side plan view of the modular mounting block of FIG. 1.
Figure 3:
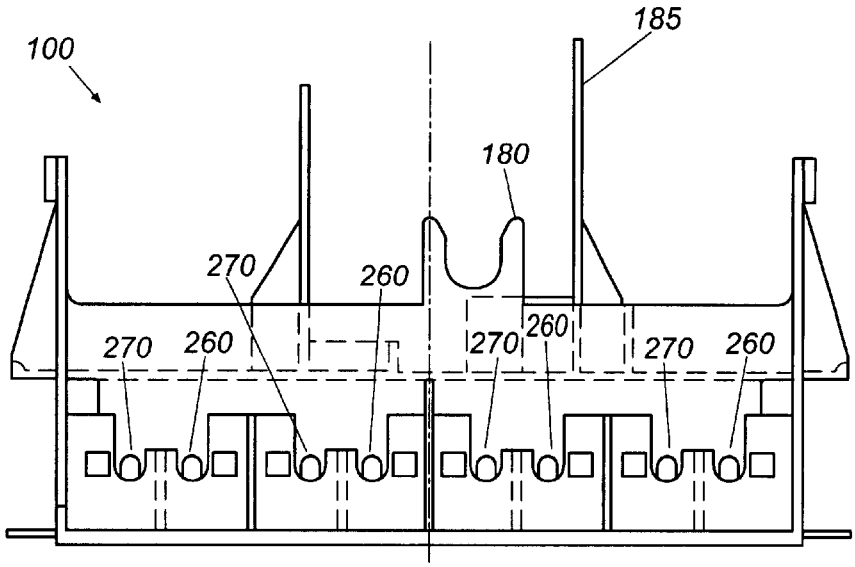
FIG. 3 is a front plan view of the modular mounting block of FIG. 1.
Figure 4:
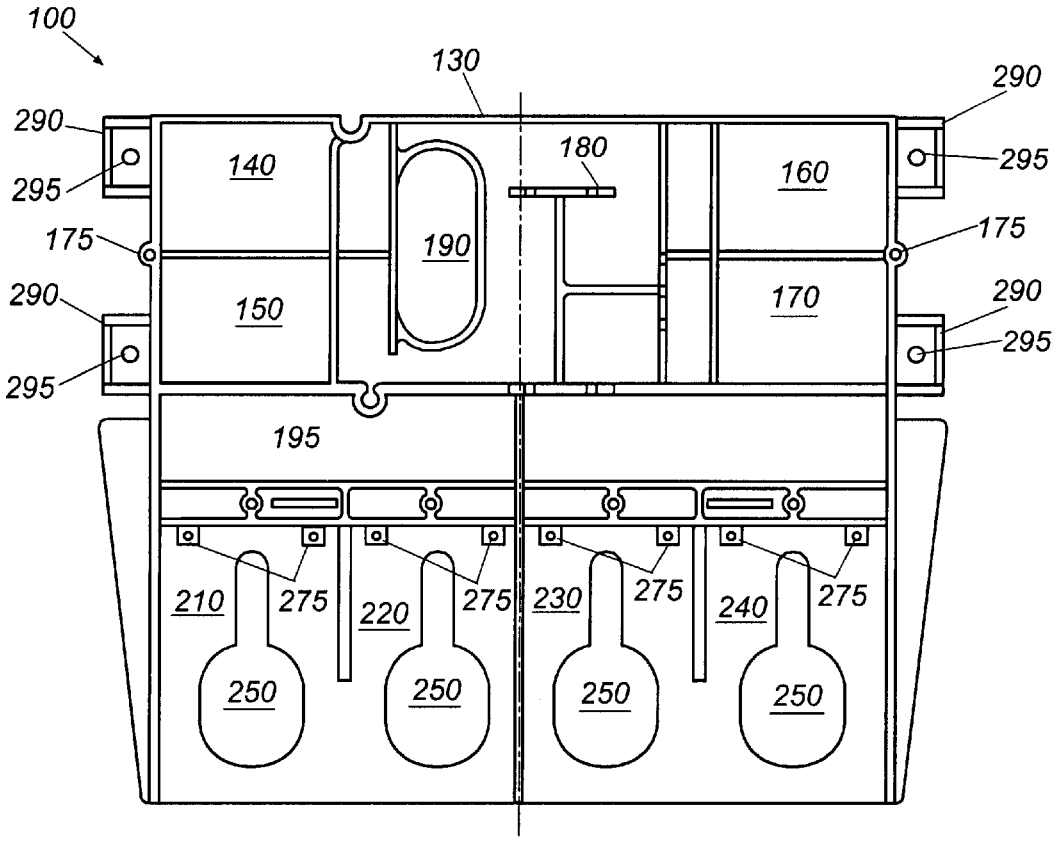
FIG. 4 is a top plan view of the modular mounting block of FIG. 1.

Referring now to the drawings, in which like numerals refer to like elements throughout the several views, FIGS. 1–4 show one aspect of the present invention, a modular mounting block 100. The modular mounting block 100 preferably is a unitary element. The modular mounting block 100 preferably is molded from a substantially rigid thermoplastic, such as nylon, acetal, or similar types of substantially rigid, non-corrosive materials.

The modular mounting block 100 generally has a plurality of compartments 110 molded therein. These compartments 110 may include a number of pump compartments 120. These pump compartments 120 generally include at least one water pump compartment 130 and a plurality of syrup pump compartments 135. In this embodiment, the modular mounting block 100 has a first syrup pump compartment 140, a second syrup pump compartment 150, a third syrup pump compartment 160, and a fourth syrup pump compartment 170. It is understood that the total number, type, and location of the pump compartments 135 can vary according to the size and utilization of the beverage dispenser as a whole. For example, although the compartments 135 are shown two (2) on a side, the compartments 135 also may be arranged such that all four (4) compartments 135 are on one side, in the middle, or on any location within the mounting block 100.

The modular mounting block 100 can accommodate as many pump compartments 135 as is needed or desired. Further, each syrup pump compartments 135 is sized and shaped according to the appropriate syrup pump to be used therein. In this case, the compartments 135 are largely rectangular in shape. The pump compartments 135 also may include one or more bolt holes 175 or other types of attachment structures. The syrup pumps may be mounted within the compartments 135 via a fastener attached to the bolt hole 175 or by similar attachment means.

The water pump compartment 130 also is sized to accommodate the appropriate water pump within a rest 180. The rest 180 is substantially "U"-shaped so as to accommodate a typical water pump. Any desired shape, size, or location, however, may be used. The water pump compartment 130 also includes a divider 185 with an attachment recess 187 positioned therein. The water pump may be mounted within the compartment 130 via a fastener attached to the attachment recess 187 or by similar attachment structures or means. The water pump compartment 130 also includes a recess 190 positioned adjacent to the rest 180. The recess 190 is generally oval in shape and provides access to the pressure relief valve of a typical carbonator unit and also provides an access route for one or more fluid or gas lines.

The modular mounting block 100 also includes an overflow conduit 195. The overflow conduit 195 allows any syrup or other liquids that may spill within the pump compartments 120 to drain out of the modular mounting block 100. The individual pump compartments 120 also may include one or more recesses positioned therein to permit fluid to flow out of the compartments 120 and towards the overflow conduit 195.

The modular mounting block 100 also includes a plurality of dispensing valve compartments 200. In the embodiment shown in FIGS. 1 through 4, the modular mounting block 100 has a first dispensing valve compartment 210, a second dispensing valve compartment 220, a third dispensing valve compartment 230, and a fourth dispensing valve compartment 240. Each dispensing valve compartment 200 has a recess 250 positioned therein so as to accommodate a typical dispensing valve nozzle and an activation lever. Each valve compartment 200 also has a syrup conduit support 260 and a water conduit support 270 formned therein. The conduit supports 260, 270 are sized to permit a fluid line and/or a fluid line coupling to be attached to the dispensing valve. As with the syrup pump compartments 135, the number of the valve compartments 200 depends upon the size and utility of the beverage dispenser as a whole. It is understood that any shape, size, or location of the valve compartments 200 may be used. Each dispensing valve compartment 230 also includes one or more attachment recesses 275 formed therein. The dispensing valve may be mounted within the compartment 230 via a fastener such as a wire clip attached to the attachment recess 175 or by similar attachment structures or means.

The modular mounting block 100 also has a number of footings 290 formed thereon. Each footing 290 may have a bolt hole 295 therethrough or similar structures so as to secure the modular mounting block 100 to the water bath by bolts, screws, or other types of conventional fastening means.

Figure 5:
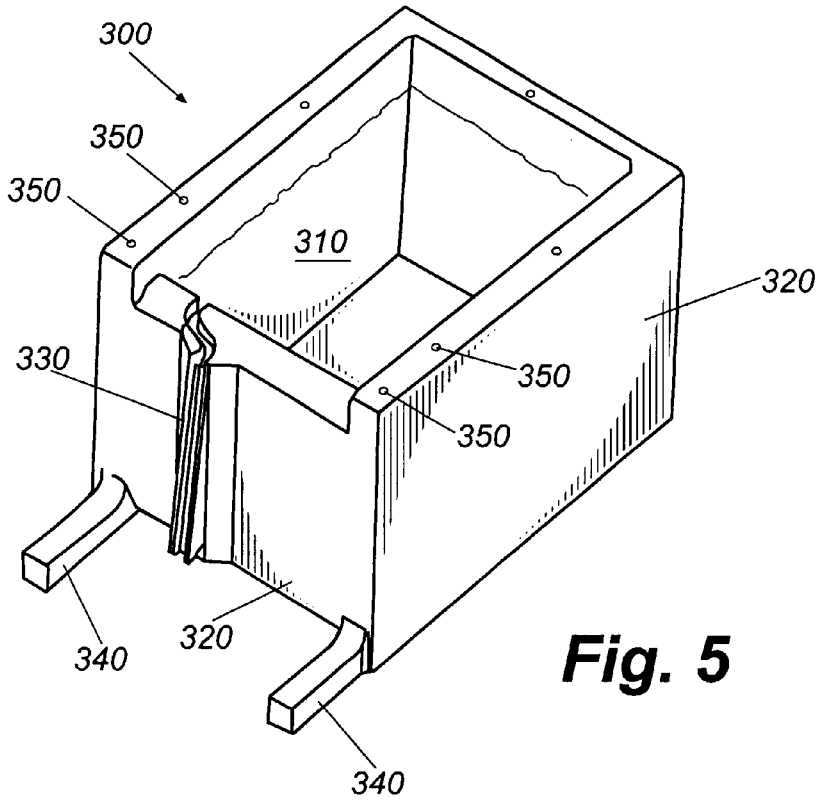
FIG. 5 is a perspective view of the water bath of the present invention.
Figure 6:
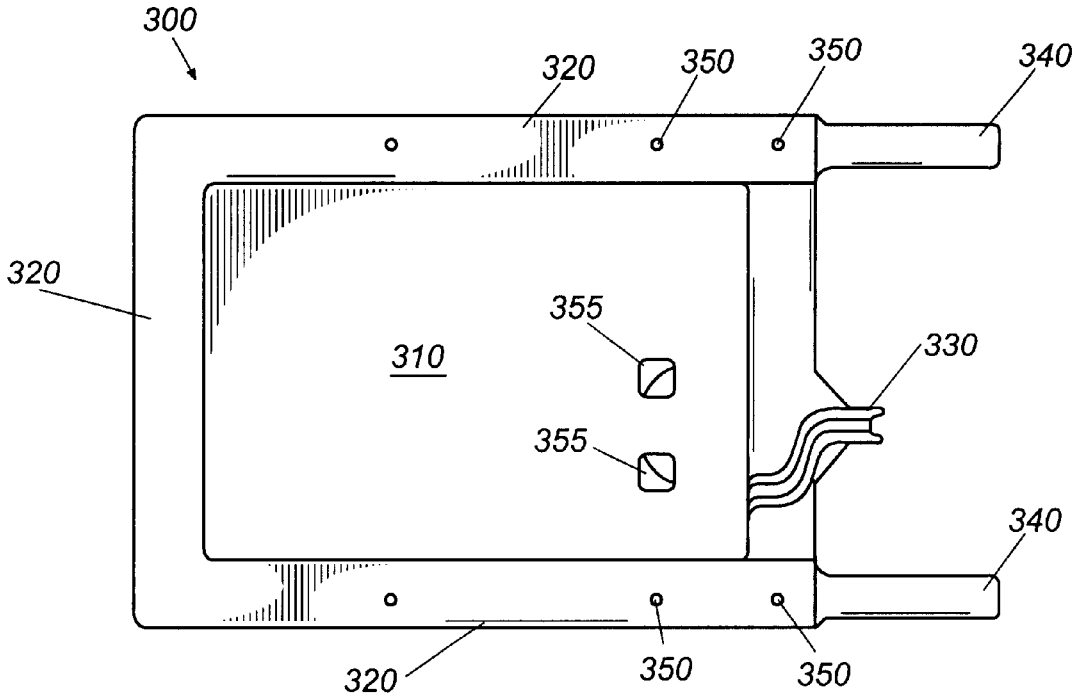
FIG. 6 is a top plan view of the water bath of FIG. 5.

FIGS. 5 and 6 show a water bath 300 for use with the present invention. The water bath 300 also may be a molded plastic. For example, the water bath 300 may be roto-molded from High Density Polyethylene ("HDPE") or similar types of materials. The water bath 300 is generally formed in place. As is shown, the water bath 300 includes a bath recess 310 formed by a plurality of walls 320. One of the walls 320 may include a drip path 330 molded therein. The drip path 330 extends from the bath recess area 310 along the length of the wall 320. The drip path 330 aligns with the overflow conduit 195 so as to allow for any excess syrup or other fluids to escape from the modular mounting block 100 without spilling into the water bath 300. Most known beverage dispensers result in the excess syrup leaking into the water bath. The drip path 330, in combination with the overflow conduit 195, avoids this problem.

The water bath 300 may have a plurality of support legs 340. The water bath 300 also may have a plurality of bolt holes 350 or other accommodations on the wall 320 surrounding the recess area 310 so as to attach the modular mounting block 100 as described above. Finally, the water bath 300 may have one or more carbonator guides 355 positioned within the bath recess 320 so as to position the carbonator unit therein.

Figure 7:
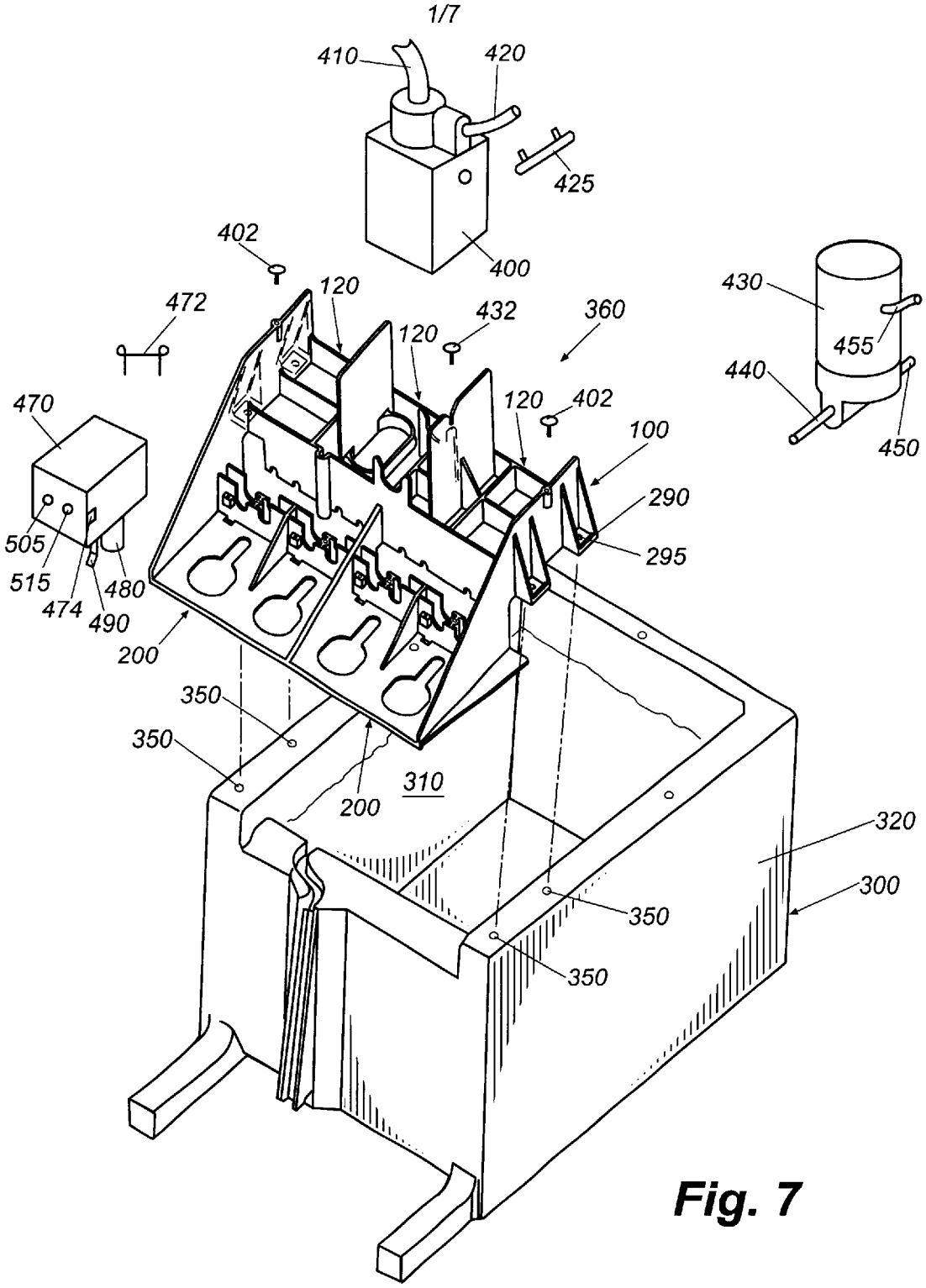
FIG. 7 is an exploded view of the modular mounting block, one water bath, one dispensing valve, one syrup pump, and the water pump of the present invention.

FIG. 7 shows the modular mounting block 100 positioned on top of the water bath 300 so as to form a beverage dispenser 360. As is shown, the modular mounting block 100 is positioned by the footings 290 on top of the walls 320 of the water bath 300. One or more bolts, screws, or other conventional types of fastening means may secure the modular mounting block 100 in place via the bolt holes 295 of the modular mounting block 100 and the bolt holes 350 of the water bath 300. A snap fit, a slide pin, or similar connection devices also may be used. The overflow conduit 195 of the modular mounting block 100 is positioned over the drip path 330 of the water bath 300 for communication therewith.

Also shown in FIG. 7 is a syrup pump 400. The syrup pump 400 may be of conventional design. A preferred syrup pump 400 may be made by Lancer Corporation of San Antonio, Tex., and sold under the mark "Mini-Pump". One syrup pump 400 may fit within each of the syrup pump compartments 140, 150, 160, 170. After the syrup pumps 400 are positioned within each of the compartments 140, 150, 160, 170, several of the syrup pumps 400 may be secured by a single screw 402. The screw 402 fits within the bolt hole 175 and may anchor two or more pumps 400 per side at a time. Alternatively, the syrup pumps 400 may snap into place within the compartments 140, 150, 160, 170 and be secured via a spring-loaded tab. Further, the syrup pumps 400 may be held by an integral retainer that is molded within the compartments 140, 150, 160, 170 or by a similar type of construction.

The syrup pump 400 generally has a syrup-intake line 410 and a syrup-out line 420. The pump 400 may be gas activated such that there is an incoming gas line or manifold 425. A single manifold 425 may accommodate a number of the syrup pumps 400. The mounting block 100 supports and secures the pumps 400, the lines 410, 420, and the manifold 425. The syrup-intake line 410 is generally connected between the syrup pump 400 and a syrup source such as a bag-in-box, a figal, a syrup tank, or other types of conventional syrup sources. The syrup-out line 420 generally leads to a plurality of syrup cooling coils (not shown) positioned within the water bath 300 of the beverage dispenser 360. The syrup is cooled to the appropriate temperature within the syrup cooling coils in a conventional manner.

FIG. 7 also shows a water pump 430. The water pump 430 may be of conventional design. A preferred water pump 430 may be made by Flojet Corporation of Irvine, California. The water pump 430 is positioned within the rest 180 of the water pump compartment 130. The water pump 430 fits within the compartment 130 and may be secured by a single screw 432 via the attachment recess 187. The pump 430 also may be mounted by screws, bolts, or other conventional types of fastening means. Alternatively, the water pump 430 may snap into place within the compartment 130 and may be secured via a spring-loaded tab. Further, the water pump 430 may be held by an integral retainer that is molded within the compartment 130 or by a similar type of construction.

The water pump 430 generally has a water-in line 440 and a water-out line 450. The water-in line 440 generally connects the water pump 430 to a conventional water source. The water-out line 450 generally connects the water pump 430 to a carbonator unit (not shown) or other elements within a conventional water circuit such as the water cooling coils (not shown) positioned within the water bath 300. The water pump 430 may be gas activated such that there is an incoming gas line or manifold 455 connected thereto.

FIG. 7 also shows a dispensing valve 470. The dispensing valve 470 may be of conventional design. A dispensing valve 470 may be made by Lancer Corporation of San Antonio, Tex., and sold under the mark "LMV". The dispensing valve 470 also may be a modular dispensing valve such as that disclosed in commonly owned U.S. patent application Ser. No. 09/245,594, entitled "Modular Volumetric Valve System". Patent application Ser. No. 09/245,594 is incorporated herein by reference.

The dispensing valve 470 generally includes a dispensing nozzle 480 and an activation lever 490. The dispensing valve 470 also has a syrup-intake port 500 and a water-intake port 510. The syrup-intake port 500 mates with a fitting connected to a syrup-intake line 505 as described in more detail below. Likewise, the water-intake port 510 mates with a fitting connected to a water-intake line 515. The syrup-intake line 505 connects the dispensing valve 470 with the syrup cooling coils (not shown) positioned within the water bath 300. Likewise, the water-intake line 515 connects the dispensing valve 470 with the water cooling coils (not shown) positioned within the water bath 300. The syrup from the syrup-intake line 505 and the water from the water-intake line 515 are mixed within the dispensing valve 470 such that a beverage, such as carbonated soft drink, comes out of the nozzle 480 when the activation lever 490 is moved.

The dispensing valve 470 is positioned within each of the dispensing valve compartments 200. The nozzle 480 of the dispensing valve 470 is positioned within the recess 250 of each compartment 200. The dispensing valve 470 may have an a clip recess 474 formed therein such that the dispensing valve 470 fits within the compartment 200 and may be secured by a wire clip 472. The wire clip 472 passes through the clip recess 474 and into the attachment recess 175 of the mounting block 100. Alternatively, screws, bolts, or other conventional types of fastening means may be used. The dispensing valve 470 also may snap into place within the compartment 200 and be secured via a spring-loaded tab or by a similar type of construction. Further, the dispensing valve 470 may be held by an integral retainer that is molded within the compartment 200 or by a similar type of construction. Likewise, the syrup-intake line 505 and the water-intake line 515 are positioned within the syrup conduit support 260 and the water conduit support 270 respectively.

Figure 8:
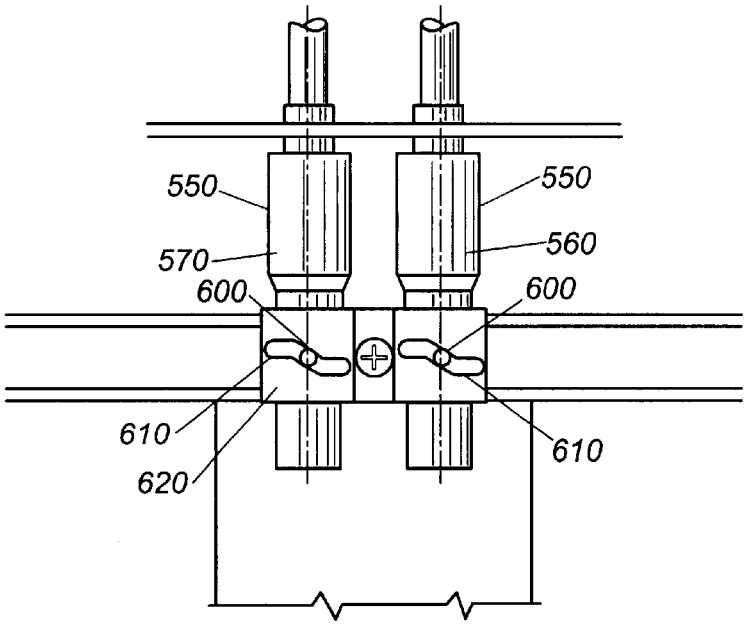
FIG. 8 is a top plan view of the quick disconnect fitting of the present invention.

In order to provide for the quick insertion or removal of the dispensing valve 470, the syrup-intake line 505 and the water-intake line 515 are both provided with a quick disconnect fitting 550. The quick disconnect fittings 550 are shown in FIGS. 8 through 11. As is shown in FIG. 8, a water quick disconnect fitting 560 is used on the water-intake line 515 and a syrup quick disconnect fitting 570 is connected to the syrup-intake line 505 to control the flow of fluid therethrough.

Figure 9:
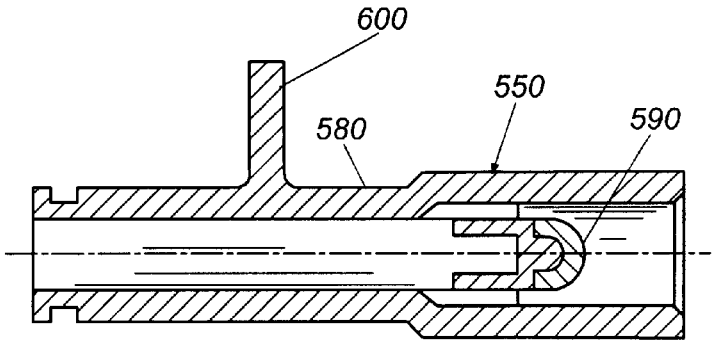
FIG. 9 is a side cross-sectional view of the quick disconnect fitting of FIG. 8.
Figure 10:
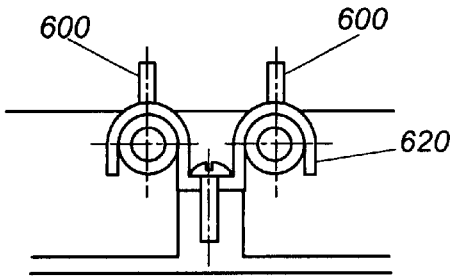
FIG. 10 is cross-sectional view of the frame securing the quick disconnect fitting of FIG. 8.

As is shown in FIG. 9, the quick disconnect fittings 550 include an outer housing 580 surrounding a retractable plunger 590 for movement therein. The plunger 590 has an arm 600 connected thereto. The arm 600 is positioned within a channel 610 of the outer housing 580. The plunger 590 is maneuvered by adjusting the position of the arm 600 within the channel 610. One end of the quick disconnect fitting 550 is attached to the syrup-intake line 505 or the water-intake line 515 while the other end of the quick disconnect fitting 550 is connected to the ports 500, 510 of the dispensing valve 470. The arm 600 may be maneuvered to open or close the plunger 590 so as to permit or stop fluid flow therethrough. As is shown in FIG. 10, the quick release mechanism 550 is held in place by a frame 620 secured to the syrup conduit support 260 or the water conduit support 270. Significantly, the incoming lines 505, 515 can be retained without fittings or fastening means.

Figure 11:
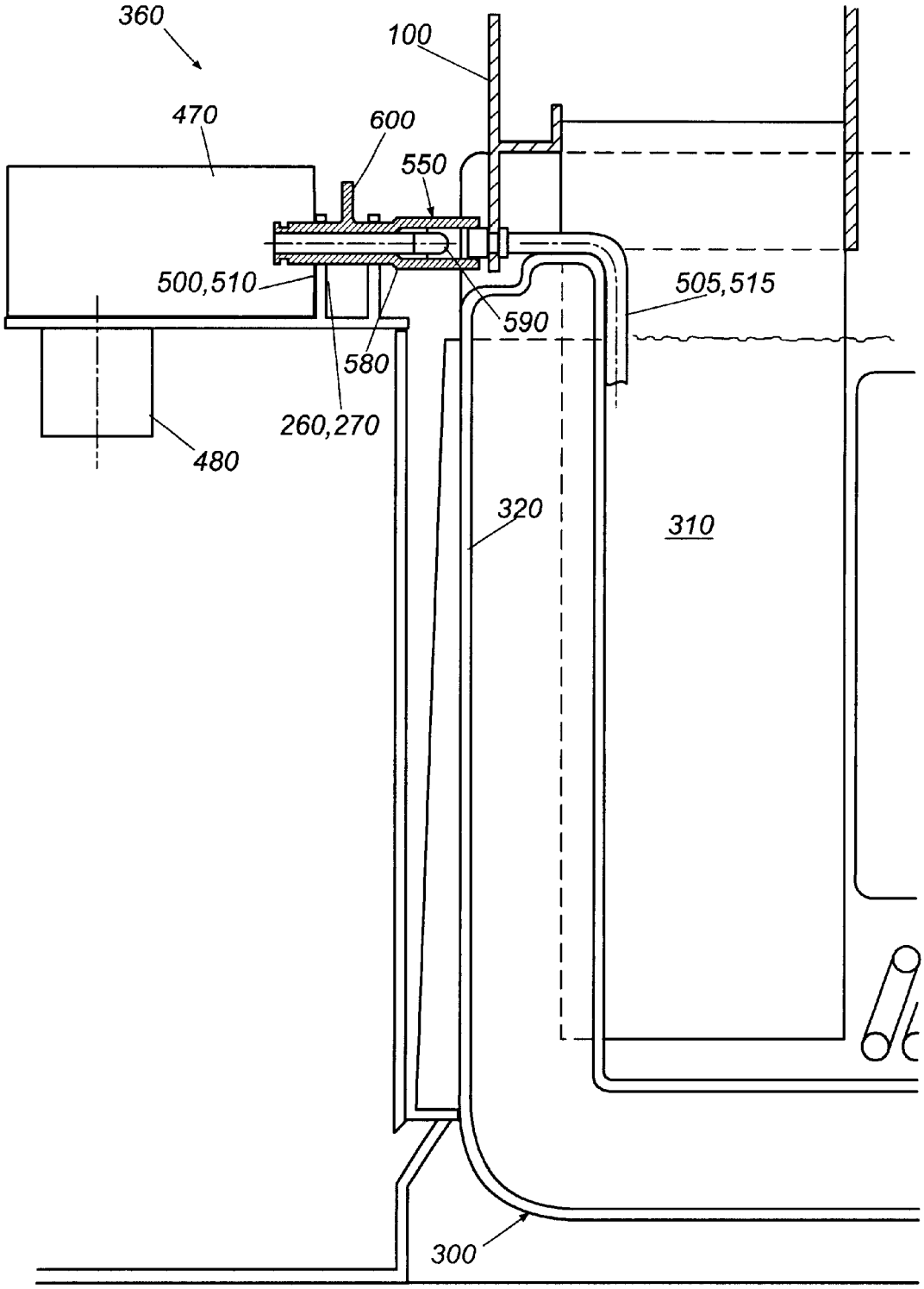
FIG. 11 is a side cross-sectional view of the water bath, one dispensing valve, the modular mounting block, and the quick disconnect fitting of the present invention.

As is shown in FIG. 11, the dispensing valve 470 simply snaps into the quick disconnect fittings 550. The arm 600 is maneuvered into the "open" position so as to permit fluid flow therethrough. Likewise, when in the "closed" position, the plunger 590 blocks the syrup in-take line 505 or the water-intake line 515 such that the dispensing valve 470 may be easily installed or removed via the ports 500, 510. The quick disconnect fittings 550 thus provide the user of the beverage dispenser 360 with the ability to install or replace components quickly and easily without the use of a separate mounting block. Specifically, the use of the quick disconnect fittings 550 allows the user to remove, for example, one dispensing valve 470, while still operating the remaining dispensing valves 470. It is understood that although the quick disconnect fitting 550 has been discussed in terms of the dispensing valve 470, a similar arrangement could be used with respect to the syrup pumps 400, the water pump 430, or any other component of the beverage dispenser 360 as a whole.

The use of the modular mounting block 100 thus provides for fast and efficient construction of the beverage dispenser 360 and also for fast and efficient replacement of components within the beverage dispenser 360. By way of example, the use of the modular mounting block 100 herein eliminates the use of about one-third (⅓) of the parts as compared to a conventional beverage dispenser. The elimination of the screws, retainers, and brackets generally used to attach the pumps and the line fittings is in itself a significant reduction in parts and time. This overall simplification of the design of the beverage dispenser 360 may reduce the time it takes to construct the beverage dispenser 360 by about one-third (⅓) or about thirty-three percent (33%).

Figure 12:
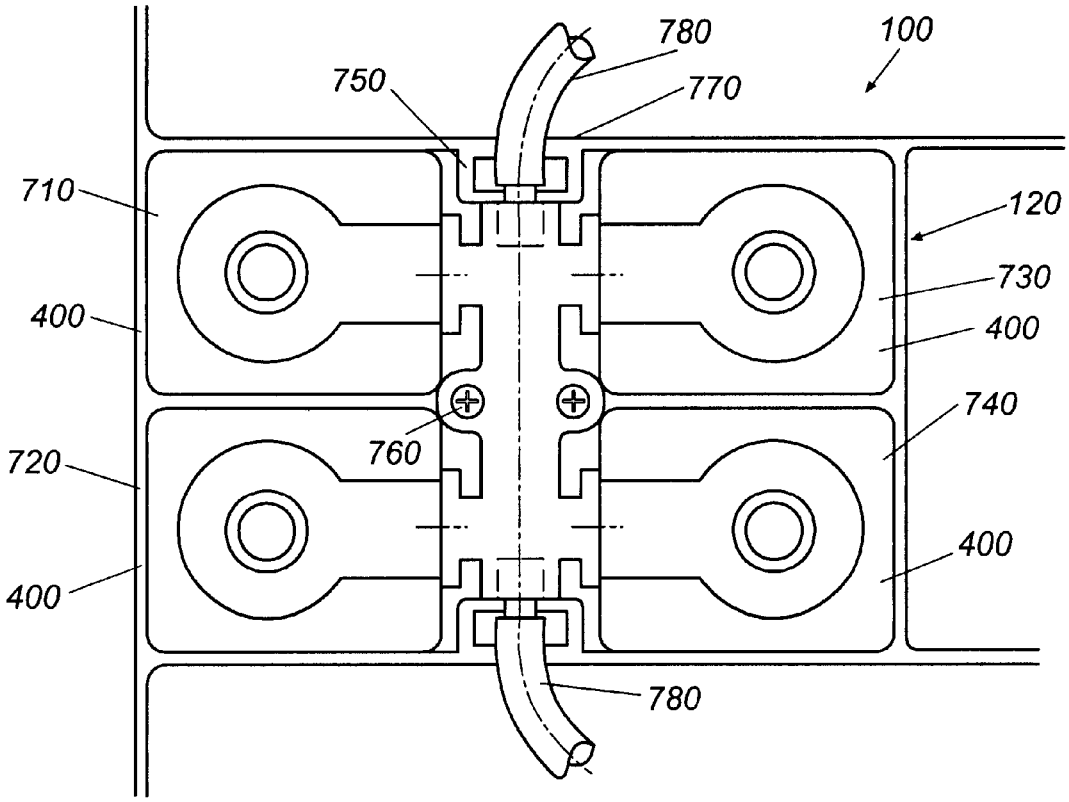
FIG. 12 is a top plan view of an alternative embodiment of the present invention showing the syrup compartments on one side of the mounting block.

FIG. 12 shows an alternative embodiment of the mounting block 100. In this embodiment, the pump compartments 120 are located adjacent to each other. In other words, the pump compartments 710, 720, 730, 740 are all located on one side of the mounting block 100. The syrup pumps 400 are positioned within each of the pump compartments 710, 720, 730, 740. The syrup pumps 400 are connected by a common gas manifold 750. Similar to the manifold 425 described above, the manifold 750 provides carbon dioxide to each of the syrup pumps 400. The manifold 750 also retains the pumps 400 within their respective compartments 710, 720, 730, 740. The manifold 750 may be retained in place via a single screw 760 or by similar attachment means. The mounting block 100 may have a saddle 770 formed therein so as to accommodate manifold 750 and the gas lines 780 leading to the manifold 750.

The use of the common manifold 750 and the single screw 760 in this embodiment thus increases even further the simplicity of construction and installation offered by the present invention. The syrup pumps 400 thus may be installed quickly and easily with a miminum of parts. Likewise, the removal and replacement of the syrup pumps 400, if needed, is likewise simplified.

It should be understood that the foregoing relates only to the preferred embodiments of the present invention and that numerous changes may be made herein without departing from the spirit and scope of the invention as defined by the following appended claims.

I claim:

1. A modular beverage dispenser, comprising:

a water bath;

a mounting block fixedly attached thereto;

said mounting block comprising a plurality of pump compartments and a plurality of dispensing valve compartments;

a water pump positioned within a first one of said plurality of pump compartments;

a syrup pump positioned within a second one of said plurality of pump compartments; and a dispensing valve positioned within one of said plurality of dispensing valve compartments.

2. The modular beverage dispenser of claim 1, wherein said water bath comprises a thermoplastic material.

3. The modular beverage dispenser of claim 1, wherein said mounting block comprises a thermoplastic material.

4. The modular beverage dispenser of claim 1, wherein said water bath comprises a drip path molded therein.

5. The modular beverage dispenser of claim 4, wherein said mounting block comprises an overflow conduit in alignment with said drip path of said water bath.

6. The modular beverage dispenser of claim 1, wherein said first pump compartment comprises a water pump compartment.

7. The modular beverage dispenser of claim 1, wherein said second pump compartment comprises a syrup pump compartment.

8. The modular beverage dispenser of claim 1, wherein said water pump is retained within said first pump compartment by a screw.

9. The modular beverage dispenser of claim 1, wherein said syrup pump is retained within said second pump compartment by a screw.

10. The modular beverage dispenser of claim 1, wherein said dispensing valve is retained within said dispensing valve compartment by a clip.

11. The modular beverage dispenser of claim 1, further comprising a plurality of fluid lines connected to said water pump, said syrup pump, and said dispensing valve.

12. The modular beverage dispenser of claim 11, wherein several of said plurality of fluid lines each comprise a quick disconnect fitting.

13. The modular beverage dispenser of claim 12, wherein said quick disconnect fitting comprises a retractable plunger positioned within a housing.

14. The modular beverage dispenser of claim 13, wherein said retractable plunger comprises an arm so as to position said retractable plunger within said housing.

15. The modular beverage dispenser of claim 12, wherein said dispensing valve snaps into said quick disconnect fitting.

16. A modular beverage dispenser, comprising:

a water bath;

a mounting block fixedly attached thereto;

said mounting block comprising a single piece themoplastic;

said mounting block comprising a plurality of compartments; and a dispensing valve positioned within one of said plurality of compartments.

17. The modular mounting block of claim 16, further comprising a water pump positioned within a second one of said plurality of compartments.

18. The modular mounting block of claim 16, further comprising a syrup pump positioned within a second one of said plurality of compartments.

* * * * *